US005421911A

United States Patent [19]

Schoen

[11] Patent Number: 5,421,911

[45] Date of Patent: * Jun. 6, 1995

[54] REGULAR GRAIN ORIENTED ELECTRICAL STEEL PRODUCTION PROCESS

[75] Inventor: Jerry W. Schoen, Middletown, Ohio

[73] Assignee: Armco Inc., Middleton, Ohio

[ * ] Notice: The portion of the term of this patent subsequent to Feb. 22, 2011 has been disclaimed.

[21] Appl. No.: 155,333

[22] Filed: Nov. 22, 1993

[51] Int. Cl.[6] ..... H01F 1/04

[52] U.S. Cl. ..... 148/111; 148/113

[58] Field of Search ..... 148/111, 112, 113, 308

[56] References Cited

U.S. PATENT DOCUMENTS

| | | | |
|---|---|---|---|
| 3,333,992 | 8/1967 | Kohler | 148/113 |
| 3,764,406 | 10/1973 | Littmann | 148/111 |
| 3,802,937 | 4/1974 | Kohler | 148/111 |
| 3,843,422 | 10/1974 | Henke | 148/111 |
| 3,986,602 | 10/1976 | Regitz | 148/110 |
| 4,202,711 | 5/1980 | Littmann et al. | 148/111 |
| 4,493,739 | 1/1985 | Fujiwara et al. | 148/111 |
| 5,061,326 | 10/1991 | Schoen | 148/12.4 |

OTHER PUBLICATIONS

"Developments of Grain Oriented Si Steel Sheets with Low Iron Loss", Sadyori et al, Kawasaki Seitetsu Giho, vol. 21, No. 3, pp. 93–98, 1989.

*Primary Examiner*—Melvyn J. Andrews

*Assistant Examiner*—Sikyin Ip

*Attorney, Agent, or Firm*—Larry A. Fillnow; Robert J. Bunyard; Robert H. Johnson

[57] ABSTRACT

The present invention provides a steel composition and method for producing a high quality regular grain oriented electrical steel having less than 0.005% aluminum using a single cold reduction step. A high austenite volume fraction, the use of an annealing separator coating with high sulfur or a sulfur bearing atmosphere to provide strong surface energy grain growth, a quench after initial annealing to provide the optimum microstructure having a small amount of martensite with a fine carbide dispersion and various chemistry changes are included in the method. Excess manganese in combination with tin, which has been found to act similarly to excess Mn, are maintained at a total level less than 0.03%. The use of chromium in an amount ranging from 0.11% to 1.2% provides outstanding control of stability for secondary grain growth. The finished regular grain oriented electrical steel has superior and more uniform magnetic quality than available from previous single stage processes and the magnetic quality is comparable to regular grain oriented electrical steels made using processes requiring two stages of cold reduction separated by an annealing step. The present invention also permits the production of thinner gauges while still using a single stage of cold reduction.

11 Claims, 3 Drawing Sheets

REGULAR GRAIN ORIENTED ELECTRICAL STEEL PRODUCTION PROCESS

BACKGROUND OF THE INVENTION

The manufacture of grain oriented electrical steels requires critical control of chemistry and processing to achieve the desired magnetic properties in a stable and reproducible manner. The present invention produces excellent magnetic properties in (110)[001] oriented electrical steel having less than 0.005% Al using a single cold reduction stage.

Grain oriented electrical steels are characterized by the level of magnetic properties developed, the grain growth inhibitors used and the processing steps which provide these properties. Regular (or conventional) grain oriented electrical steels typically have magnetic permeability below 1880 as measured at 796 A/m. Regular grain oriented electrical steels are typically produced using manganese and sulfur (and/or selenium) as the principle grain growth inhibitor(s) with two cold reduction steps separated by an annealing step. Aluminum (less than 0.005%), antimony, boron, copper, nitrogen and other elements are sometimes present and may supplement the manganese sulfide/selenide inhibitor(s) to provide grain growth inhibition.

Representative processes for producing regular grain oriented electrical steel are taught in U.S. Pat. Nos. 3,764,406; 3,843,422; 4,202,711 and 5,061,326 which are incorporated herein by reference. Regular grain oriented electrical steel strip or sheet is generally produced using two stages of cold reduction in order to achieve the desired magnetic properties. While a single stage cold reduction process has long been sought since two or more processing steps (at least one cold rolling stage and an intermediate anneal) are eliminated, the magnetic properties have lacked the desired level of consistency and quality.

Regular grain oriented electrical steel may have a mill glass film, commonly called forsterite, or an insulative coating, commonly called a secondary coating, applied over or in place of the mill glass film, or may have a secondary coating designed for punching operations where laminations free of mill glass coating are desired in order to avoid excessive die wear. Generally, magnesium oxide is applied onto the surface of the steel prior to the high temperature anneal which serves as an annealing separator coating. These coatings also influence the development and stability of secondary grain growth during the final high temperature anneal, react to form the forsterite (or mill glass) coating on the steel and effect desulfurization of the base metal during annealing.

To obtain material having a high degree of cube-on-edge orientation, the material must have a structure of recrystallized grains with the desired orientation prior to the high temperature portion of the final anneal and must have grain growth inhibition to restrain primary grain growth in the final anneal until secondary grain growth occurs. Of great importance in the development of the magnetic properties of electrical steel is the vigor and completeness of secondary grain growth. This depends on having a fine dispersion of manganese sulfide (or other) inhibitors which is capable of restraining primary grain growth in the temperature range of 535°-925° C. (1000°-1700° F.). Thereafter, the cube-on-edge nuclei have sufficient energy to develop into large secondary crystals which grow at the expense of the less perfectly oriented matrix of primary grains. The dispersion of manganese sulfide is typically provided by high temperature slab or ingot reheating prior to hot rolling during which the fine manganese sulfide is precipitated.

The production of cube-on-edge oriented electrical steel requires that the material be heated to a temperature which dissolves the inhibitor prior to hot rolling so that during hot rolling the inhibitor is precipitated as small, uniform particles. U.S. Pat. No. 2,599,340 disclosed the basic process for the production of material from ingots and U.S. Pat. Nos. 3,764,406 and 4,718,951 obtained good magnetic properties from material which was continuously cast as slab followed by heating and hot rolling the cast slab prior to the conventional hot rolling step to reduce the size of the columnar grain structure.

Work done in the past, as represented in U.S. Pat. No. 3,333,992 (incorporated herein by reference), added large amounts of sulfur during the early portion of the final high temperature anneal by providing a sulfur-bearing annealing atmosphere or surface coating or both. However, achieving permeabilities at 796 A/m consistently in excess of 1800 required at least two cold reduction stages separated by an annealing step.

U.S. Pat. No. 4,493,739 teaches a method for producing regular grain oriented electrical steel using one or two stages of cold rolling. This patent teaches the use of 0.02–0.2% copper in combination with control of the hot mill finishing temperature to improve the uniformity of the magnetic properties. Phosphorus was controlled to less than 0.01% to reduce inclusions. Tin up to 0.10% could be employed to improve core loss of the finished grain oriented electrical steel by reducing the size of the (110)[001] grains. The manganese sulfide precipitates were considered to be weak and the uniformity of the magnetic properties were improved by forming fine copper sulfide precipitates to supplement the manganese sulfide inhibitor. During hot roll finishing, the entrance and exit temperatures were controlled to be from 1000°-1250° C. and 900°-1150° C., respectively. All of the examples of U.S. Pat. No. 4,493,739 show a conventional two stage cold rolling process. The manganese/copper sulfide precipitates formed after hot rolling were fine and uniformly dispersed and heavy 60–80% cold reductions were required for grain size control and texture development. U.S. Pat. No. 4,493,739 implied that unstable secondary recrystallization would result with a single stage of cold reduction process.

U.S. Pat. No. 3,986,902 is related to excess manganese in regular grain oriented electrical steel. The patent uses manganese sulfide for the grain growth inhibitor. Hot working causes these precipitates to grow appreciably and to be concentrated intergranularly such that the precipitates are less effective as grain growth inhibitors. It is therefore essential that the precipitates be dissolved in solid solution and that they precipitate as finely dispersed particles during or after the final step of hot rolling to band. Prior art practices discussed in this patent reviewed the need to provide a silicon steel with 0.07–0.11% manganese and 0.02–0.4% sulfur to provide the necessary grain growth inhibitors. Manganese in excess of that required to combine with sulfur to form manganese sulfide was present. The excess manganese was desired to prevent hot shortness. However, higher excess manganese decreased the solubility of manganese sulfide and required higher slab or ingot reheating temperatures to dissolve the manganese sulfide. The patent sought to lower reheating temperatures to 1250° C. (2290° F.) or less by reducing the solubility product to a maximum of about 0.0012%. Effective grain growth inhibition with less manganese sulfide required lowering the levels of insoluble oxides, such as $Al_2O_3$, MnO, etc., in the steel. It was believed that the oxides had very low solubility in solid steel, particularly at the lower reheating temperatures desired by this invention. Sulfur also had a tendency to react with the oxide inclusions and form oxysulfides, negatively influencing the solubility limits and affecting the development of the desired cube-on-edge orientation. The oxide inclusions noted in U.S. Pat. No. 3,986,902 were incurred during melting and teeming.

Various attempts have been made to reduce the oxygen content to minimize such inclusions. U.S. Pat. No. 3,802,937 used lower amounts of manganese sulfide and minimized oxide nucleation by protecting the pouring stream during teeming to avoid reoxidation. The patent required that the manganese sulfide solubility product be maintained at less than 0.0012% and preferably from 0.0007–0.0010%. This was accomplished, for example, by using 0.05% manganese and 0.02% sulfur. Reducing either sulfur, manganese or both served to provide a lower solubility product; however, since the sulfur must be removed in the final anneal, it was preferred to keep sulfur low and maintain a controlled level of manganese. This resulted in a process having about 0.07–0.08% manganese and about 0.011–0.015% sulfur. The excess manganese content insured that all of the sulfur was combined as manganese sulfide. As previously mentioned, control of the reoxidation products enabled lower levels of manganese and sulfur with the lower slab reheating temperatures. Lower manganese-to-sulfur ratios (about 1.7) could be used while avoiding hot brittleness as compared with previous practices in the art which required ratios of about 3.0. Per the teachings of U.S. Pat. No. 3,802,937, the slabs were reheated to a temperature of less than 1260° C. (2300° F.) and hot rolled to 1.3–2.5 mm (0.05–0.10 inch) thickness before the temperature fell to between 790°–950° C. (1450°–1750° F.). After hot rolling, the steel is cooled to between 450°–560° C. (850°–1050° F.) prior to coiling. Annealing of the hot rolled bands at a temperature of at least 980° C. (1800° F.) was preferred but optional. The bands were cold reduced to an intermediate thickness, annealed and again cold reduced to a typical final thickness of about 0.28 mm (0.011 inch). The steel was then decarburized at a temperature of 760°–81 5° C. (1400°–1500° F.) to reduce the carbon to 0.007% or less and provide primary recrystallization and subjected to a final anneal at about 1065°–1175° C. (1950°–2150° F.) to effect secondary recrystallization. The one example used 0.031% carbon, 0.055% manganese, 0.006% phosphorus, 0.02% sulfur, 2.97% silicon, 0.002% aluminum, 0.005% nitrogen and balance iron.

A method to produce a regular grain oriented electrical steel using a single cold reduction step as one of the processing steps is taught in USSN 07/974,772 (incorporated herein by reference). This patent application discloses the use of uncombined manganese below 0.024%, the addition of sulfur in the annealing separator and the control of the austenite volume fraction at 1150° C. to at least 7% to enable the use of a single stage cold reduction.

The chemistry for regular grain oriented electrical steel having a manganese sulfide inhibitor system has typically restricted the level of chromium to about 0.06% maximum (see U.S. Pat. No. 3,986,902; column 5, line 47) as an accepted commercial specification.

The addition of chromium in high permeability electrical steel has been in small amounts for supplementing an aluminum nitride inhibitor system or larger amounts when used as a coating additive, such as chromic acid. An example of chromium being used to supplement the aluminum nitride inhibitor system is WO 9313236 where chromium ranged from 0.02–0.12%. Several Japanese patent applications (Japanese 02200731; 02200732; and 02200733) relating to high permeability electrical steel having an aluminum nitride inhibitor system taught the addition of chromium from 0.07–0.25% in a composition of 2.0–4.0% silicon, 0.025–0.095% carbon, 0.08–0.45% manganese, 0.015% max sulfur, 0.01–0.06% aluminum, 0.003–0.0130% nitrogen, 0.005–0.045% phosphorus and up to 1.5% molybdenum, vanadium, niobium, antimony, tin, titanium, tellurium and/or boron. U.S. Pat. Nos. 4,824,493 and 4,692,193 teach the addition of up to 0.4% chromium to high permeability electrical steel made using aluminum nitride as the grain growth inhibitor.

Large additions of chromium have been added to oriented low alloy steels having less than 2% silicon as evidenced in U.S. Pat. No. 4,251,296. The sum of chromium and silicon is less than 2% and typically about 1.2%.

The addition of chromium to the surface of the steel to influence the forsterite reaction or introduce strain on the base metal for domain refinement has been previously disclosed. U.S. Pat. Nos. 4,909,864 and 4,985,635 teach the coating of chromium carbides and nitrides on the polished surface of electrical steel following the final anneal to provide domain refinement. When used as a forsterite reaction inhibitor, lines of chromium metal may be plated onto the surface to be finally annealed in combination with a high energy beam (such as provided by a laser treatment) to diffuse the inhibitors into the iron base matrix after cold rolling. U.S. Pat. No. 4,032,366 teaches the addition of 0.3–6.0% hexavalent chromium to a magnesia slurry applied onto the surface of a grain oriented electrical steel.

Tin has been added to high permeability electrical steel having an aluminum nitride inhibitor system for different reasons. Japanese Patent Publication No. 53-134722 has an aluminum nitride inhibitor system and adds tin in the range of 0.1–0.5% to reduce the size of the secondary recrystallized grains. U.S. Pat. No. 5,049,205 teaches the addition of tin in lower amounts (0.01–0.10%) for a nitriding process after completion of primary recrystallization to increase the efficiency of the nitriding process in an aluminum nitride inhibitor system. Tin was recognized as reducing the amount of oxygen after decarburizing and making the sheet less susceptible to the dew point. This also contributed to more stable magnetic properties since a low dew point is difficult to maintain. U.S. Pat. No. 4,992,114 adds 0.05–0.25% tin to an aluminum nitride inhibited electrical steel. With less than 0.05% tin, the secondary recrystallization becomes unstable.

As pointed out by the above patents, the control of the manganese sulfide precipitates and the various processing steps required for producing regular grain oriented electrical steel having uniform and consistent magnetic properties is difficult. The ability to obtain the desired properties in regular grain oriented electrical steel having less than 0.005% aluminum using a single cold reduction process is even more difficult and it is this challenge to which the present invention is directed.

SUMMARY OF THE INVENTION

Regular grain oriented electrical having less than 0.005% aluminum is produced with a single stage cold reduction and has greatly improved magnetic properties when the composition of said steel provides a combined level of tin and excess manganese of less than 0.03% as calculated in Equation (1) below and a chromium addition of 0.11 to 1.2%. The additions of chromium in combination with tin and excess manganese have been found to provide improved core loss, higher permeability and enhanced process stability. Chromium also permits higher levels of residual elements such as nitrogen, titanium, nickel and molybdenum.

In the practice of the present invention, a high temperature initial anneal prior to cold rolling is used to insure the achievement of stable magnetic properties in the grain oriented electrical steel. It is preferred to cool the annealed steel from the soak temperature down to about 480°–760° C. (900°–1600° F.) followed by water quenching to room temperature. The processing of the chromium modified alloy also includes the addition of sulfur to the magnesia separator coating and/or the use of a sulfur bearing atmosphere during the final high temperature anneal to develop the desired magnetic properties.

The steels of the present invention will typically have an aim melt composition of about 2.9–3.5% silicon, 0.03–0.05% carbon, 0.2–0.5% chromium, less than 0.005% aluminum, less than 0.01% nitrogen, 0.05–0.06% manganese, 0.020–0.025% sulfur and less than 0.06% tin and balance essentially iron and normally occurring residual elements with the amount of tin and excess manganese being below 0.03% as calculated from Equation (1).

It is an object of the present invention to provide a regular grain oriented electrical steel made using a single cold reduction step which provides improved magnetic properties.

It is also an object of the present invention to provide a regular grain oriented electrical steel composition which is more tolerant of common impurities which occur steelmaking without degrading the quality of the secondary grain growth.

It is a feature of the present invention that the initial anneal may be modified to produce the desired microstructure for regular grain oriented electrical steel produced using a single stage of cold reduction.

It is also a feature of the present invention to provide a regular grain oriented electrical steel produced with a single stage cold reduction to have a more stable secondary grain growth.

It is an advantage of the present invention that larger sulfur additions may be added to the surface of the electrical steel and the magnetic properties are less sensitive to variations in the levels of sulfur.

It is a still further advantage of the present invention that the castability of the regular grain oriented electrical steel is improved and the cracking of the continuously cast slabs is reduced.

DESCRIPTION OF THE PREFERRED EMBODIMENT

Figure 1:
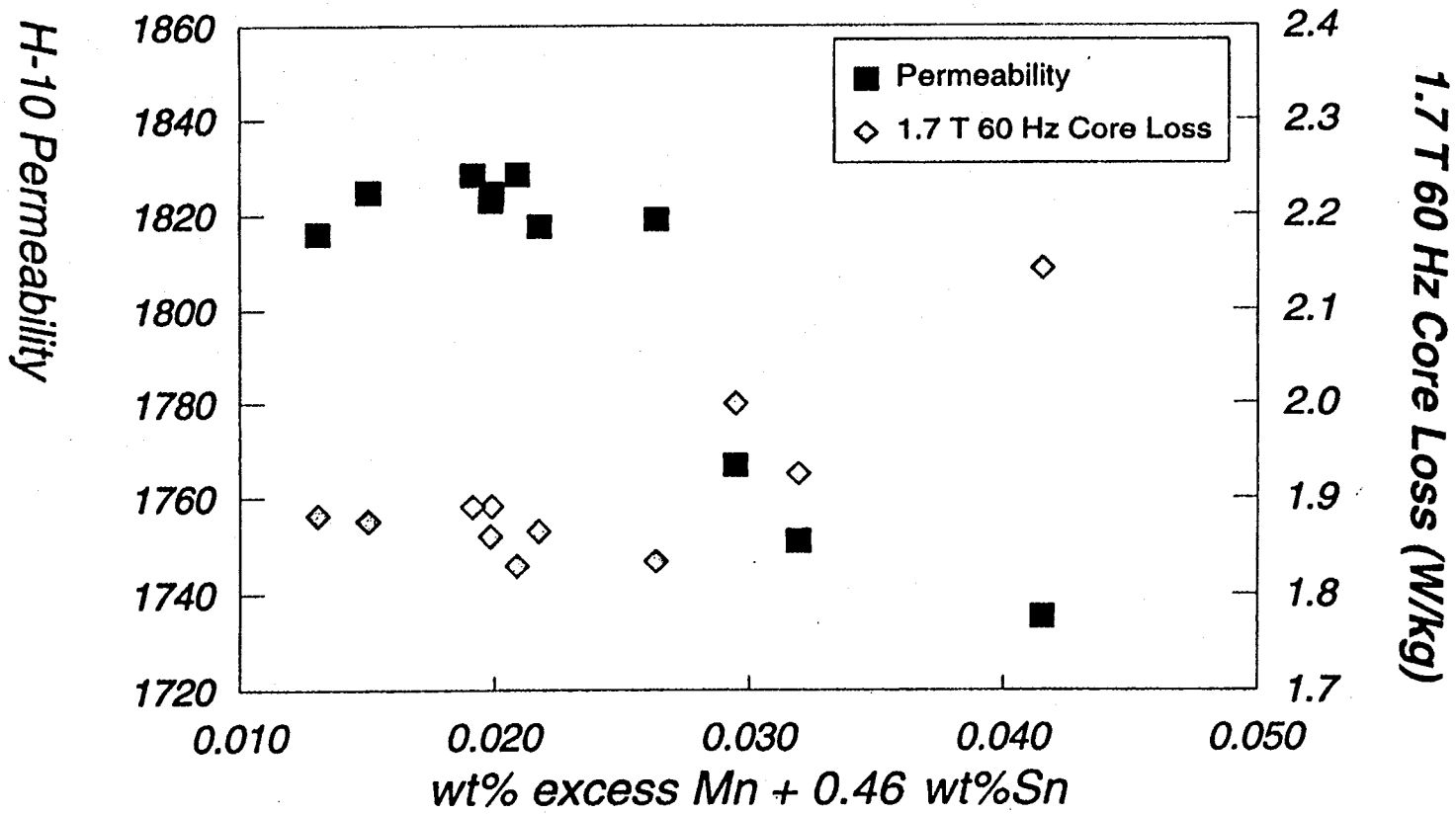
FIG. 1 is a graph exemplifying the relationship between the amount of tin and excess manganese and the permeability and the 1.7 T 60 Hz core loss of regular grain oriented electrical steel.

The present invention provides a steel composition and method for producing a high quality regular grain oriented electrical steel having less than 0.005% aluminum using a single cold reduction step. All discussion in the present patent application relating to % are in terms of weight %.

Regular grain oriented electrical steels have traditionally been produced using two stages of cold rolling separated by an intermediate annealing step in order to obtain consistent and stable magnetic properties in the finished product. Attempts in the past to produce a regular grain oriented electrical steel using a single cold rolling step resulted in highly inconsistent and unstable secondary grain growth and unacceptable magnetic properties. As discussed in USSN 07/974,772 (incorporated herein by reference), the steel was provided with controlled amounts of excess manganese, an appropriate volume fraction of austenite and an appropriate amount of sulfur on the steel surface during the final high temperature anneal to produce a more stable secondary grain growth using a single cold reduction step.

The present invention provides an improved regular grain oriented electrical steel composition for production with a single cold reduction step.

The permissible level of tin in combination with excess manganese was determined using the stoichiometric relationship of total manganese (Mn), sulfur (S) and/or selenium (Se) and tin (Sn) contents as:

$$Sn + Excess\ Mn = \%\ Mn - 1.713\%\ S - 0.707\%\ Se + 0.46\%\ Sn \quad (1)$$

Manganese will be present in the steels of the present invention in an amount of from 0.01% to 0.10%, preferably of from 0.03% to 0.07% and more preferably from 0.05% to 0.06%. Control of tin and the manganese in excess of the amount combined with sulfur and/or selenium is critical in order to obtain stable secondary grain growth and good magnetic quality using the single cold reduction process of the present invention. The level of Sn plus excess Mn may be determined using the stoichiometric relationship of the manganese, tin, sulfur and/or selenium contents as shown in Equation (1). Up to 0.03% Sn plus excess Mn, as defined in Equation 1, may be tolerated and still control the stability of the process. Preferably, the level of Sn plus excess Mn is maintained below 0.028% and more preferably below 0.024%. If conventional methods of steel melting and casting of either ingots or slabs is used to produce a starting band, a lower level of Sn plus excess Mn is advantageous to ease the dissolution of the manganese sulfide/selenide during reheating before hot rolling. If the total amount of tin and excess Mn exceeds 0.03%, the electrical steel is not suitable for production using a single stage of cold reduction.

In the practice of the present invention, tin has been found to behave like excess manganese. High levels of tin have been found to have adverse effects on process stability by impairing the function of the sulfur in the magnesia separator coating or final annealing atmosphere. Tin may be present either as a residual or as a deliberate addition made during the steelmaking process. Tin may be present up to 0.06% depending on the level of excess Mn and still maintain the required level of stability needed for secondary grain growth. Preferably, tin is maintained below 0.02% and more preferably below 0.01% to enable the steels to be processed using a single stage of cold reduction.

The present invention has discovered that it is advantageous to have chromium present in an amount from 0.11 to 1.2%. Preferably, the amount of Cr is from 0.17 to 1.2% and more preferably from 0.2 to 0.5%. The addition of Cr provides a higher permeability, improves core loss and enables the toleration of higher levels of tin and excess manganese. The improved stability of the steels of the present invention has also permitted the use of larger amounts of cold reduction for producing thinner gauges of steel with even further improvements in magnetic properties. While levels of chromium above 1.2% further reduce core loss by providing increased volume resistivity, such high levels of chromium may lower permeability and adversely affect decarburization since chromium may reduce the efficiency of the decarburization process prior to high temperature annealing. Chromium at these high levels may also have an adverse influence on the mill glass film formed during the high temperature final anneal. Finally, such high levels of chromium will increase the melt cost of the alloy and do not provide a significant improvement in magnetic quality. Therefore, in the practice of the present invention, chromium is limited to an upper limit of 1.2% and, preferably, 1% maximum.

The present invention has improved the technology from pending U.S. patent application U.S.S.N. 07/974,772 which did not recognize the benefit from adding chromium to a single stage cold reduction process for regular grain oriented electrical steel. The present invention also found the importance of tin to the excess Mn relationship in this electrical steel process and composition. Chromium is considered a residual element when present at levels below 0.1% and may be present in ferrous scrap used for melting. By adding at least 0.11% chromium and preferably at least 0.17% chromium, the upper limit for excess Mn to provide stability control in a single stage cold rolling process is increased. In 07/974,772 the upper limit for excess Mn was 0.024% and now, with the chromium addition, this upper limit is 0.03% depending on the tin content. The present invention thus provides a basis to increase the working ranges of tin and excess Mn by purposefully adding at least 0.11% Cr, and preferably at least 0.17% Cr, to allow the sum of tin and excess Mn to range from greater than 0.024% to 0.03%.

The chromium addition of the present invention also provides additional improvements which may be combined with various processing adjustments. It has been found that the grain oriented electrical steels having increased levels of chromium demonstrated a reduction in the tendency for solidification cracking, such as during continuous casting, owing to the improved castability of the steel. Higher chromium may be combined with adjustments in the initial anneal practice because the chromium alters the kinetics of austenite formation during annealing and decomposition during cooling. Other residual elements such as nitrogen, nickel and molybenum have previously been considered to be harmful in regular grain oriented electrical steel. The addition of chromium has increased the tolerable levels for these elements without sacrificing magnetic quality. This increased operating range for residual elements provides an important flexibility to be able to use a single stage of cold reduction for a wider range of chemistry.

The levels of silicon, carbon and other elements must be controlled in order to provide a critical minimum amount of austenite during the anneal preceding the single cold reduction step of the present invention. Sadayori et al. in their publication, "Developments of Grain Oriented Si-Steel Sheets with Low Iron Loss", *Kawasaki Seitetsu Giho*, vol. 21, no. 3, pp. 93–98, 1989, measured the austenite volume fraction of iron containing 3.0–3.6% silicon and 0.030–0.065% carbon at a temperature of 1150° C. (2100° F.). This work provided Equation (2) below which is used to calculate the austenite volume fraction at 1150° C. ($\gamma_{1150°\,C.}$) as:

$$\gamma_{1150°\,C.} = 694(\%C) - 23(\%Si) + 64.8 \quad (2)$$

While silicon and carbon are the primary elements of concern, other elements such as copper, nickel, chromium, tin, phosphorus and the like may be present as deliberate additions or as impurities from the steelmaking process. These elements will also affect the amount of austenite and, if present, must be considered. For the development of optimum magnetic properties in the steels of the present invention, the amount of austenite has been found to be critical in order to achieve stable secondary grain growth and the desired (110)[001] orientation. The band prior to cold reduction must possess an austenite volume fraction measured at 1150° C .($\gamma_{1150°\,C.}$)in excess of 7% and preferably in excess of 10%.

Regular grain oriented electrical steels may have silicon contents ranging from 2.5 to 4.5%. The silicon content is typically about 2.7 to 3.7% and, preferably, about 2.9 to 3.5%. Silicon is primarily added to improve the core loss by providing higher volume resistivity. In addition, silicon promotes the formation and/or stabilization of ferrite and, as such, is one of the major elements which affects the volume fraction of austenite. While higher Si is desired to improve the magnetic quality, its effect must be considered in order to maintain the desired phase balance. A more preferred steel of the invention has Si from 2.9–3.25%, Mn from 0.05–0.06% with an excess Mn of less than 0.022%, C from 0.03–0.04%, S from 0.02–0.025%, Cr from 0.2–0.5%, and Sn less than 0.015%.

Typically, carbon and/or additions such as copper, nickel and the like which promote and/or stabilize austenite, are employed to maintain the phase balance during processing. The amount of carbon present in the melt is at least 0.025% and higher minimum carbon contents may be required if some carbon is lost during processing prior to cold rolling. When the carbon is less than 0.025%, the secondary recrystallization becomes unstable and the permeability of the product is lowered. Excessively high carbon contents (above 0.08%) require excessive decarburizing times and lowers productivity. Preferably the carbon content is from 0.03–0.04% and more preferably from 0.030–0.04%. Prior to the development of the present invention, carbon losses of up to 0.01% were observed after the band was annealed at 1025°–1050° C. ( 1875°–1925° F.) for 15–30 seconds in a highly oxidizing atmosphere. Thus, the carbon content of the melt was increased to provide the proper phase balance and microstructure prior to cold reduction. Carbon above that needed to meet the requirements of phase balance and microstructure is unnecessary since the finally cold rolled strip is typically decarburized to prevent magnetic aging. With the practice of the higher chromium level of the present invention, the amount of carbon lost during annealing has been reduced and the amount of additional carbon provided in the melt stage to compensate for losses during subsequent processing has been similarly lowered.

Sulfur and selenium are added in the melt to combine with manganese to form the manganese sulfide and/or manganese selenide precipitates needed for primary grain growth inhibition. The required sulfur and/or selenium level must be adjusted to provide a tin and excess Mn level of 0.03% or less and, preferably, 0.028% or less, and more preferably, 0.022% or less based on the stoichiometric relationship of total manganese (Mn), sulfur (S) and/or selenium (Se) and tin (Sn) shown in Equation (1). Thus sulfur, if used alone, will be present in amounts of from 0.006 to 0.06% and, preferably, of from 0.015 to 0.03%. Selenium, if used alone, will be present in amounts of from 0.006 to 0.14% and, preferably, of from 0.015 to 0.05%. Combinations of sulfur and selenium may be used; however, the relative amounts must be adjusted owing to the different atomic weights of sulfur and selenium to provide the proper levels of tin and excess Mn.

In addition to the sulfur and/or selenium provided in the melt, a small amount of sulfur must be provided to the sheet surface during the final high temperature annealing step in order to obtain the desired (110)[001] grain orientation. Providing a grain growth inhibitor in the environment, as taught in U.S. Pat. No. 3,333,992 (incorporated herein by reference), allows additions of inhibitors such as sulfur and selenium to the steel from the annealing separator coating and/or atmosphere. This allows for greater flexibility in the melt composition and manganese sulfide/selenide precipitation during hot rolling while enabling attainment of the desired magnetic properties. The practice of U.S. Pat. No. 3,333,992 provided for sulfur added as various forms, including sulfur, ferrous sulfide and other compounds, which dissociate or decompose during the final high temperature anneal prior to secondary grain growth. It was believed that the sulfur-bearing additive formed hydrogen sulfide gas in the final anneal which reacted with the steel to form sulfides at the grain boundaries. The sulfide-bearing addition prevented the primary grains from becoming too large to be consumed during secondary grain growth. The amount of the sulfur-bearing addition was dictated by the minimum amount required to retard grain growth and the maximum amount which was found to not interfere with realizing the desired magnetic properties.

In the practice of the present invention, it is critical to provide sulfur to the surface of the steel sheet during the final high temperature anneal for stable secondary grain growth. If the sulfur is too low, secondary grain growth is unstable and if the level is too high, secondary grain growth is overly stable, and very large secondary grains with smooth boundaries and poorer orientation result. Both of these conditions will contribute to poorer core loss. The sulfur is typically provided by the magnesium oxide separator coating which is applied after cold rolling and prior to the final high temperature anneal. Typically, the separator coating is applied at a weight of about 2 to 10 gm/m$^2$/side (0.005–0.035 oz/ft$^2$/side) on both sheet surfaces which provides a total coating weight of 4–20 gm/m$^2$ (0.01–0.07oz/ft$^2$). The magnetic quality was strongly affected by the total sulfur provided by the coating. It has been found that a total sulfur level of at least 15 mg/m$^2$ is required to establish and maintain stable secondary grain growth; a preferred minimum amount is 20 mg/m$^2$. Acceptable magnetic properties have been obtained at levels as high as 250 mg/m$^2$. Sulfur-bearing additions may be made in many forms, such as sulfur, sulfuric acid, hydrogen sulfide or as a sulfur-bearing compound such as sulfates, sulfites and the like. Selenium-bearing additions may be employed in combination with or as a substitute for sulfur; however, the greater health and environmental hazards of selenium must be considered.

The chromium addition of the practice of the present invention appears to affect the activity of sulfur both in base metal and the applied coating. This is particularly important since larger sulfur levels may be used in the separator coating to provide stable secondary grain growth while suppressing the problems of overly stable secondary grain growth. For example, steels of the present invention containing a 0.20–0.25% chromium addition have been successfully processed using sulfur-bearing magnesia coatings which provided from 25 to 150 mg/m$^2$ sulfur at the sheet surface, demonstrating that stable secondary growth and excellent and consistent magnetic properties could be obtained using a wide range of sulfur contents provided by the separator coating. This sulfur addition may also be provided by the atmosphere during the high temperature annealing process.

Acid soluble aluminum is maintained below 50 ppm (0.005%) and preferably under 15 ppm (0.0015%) in the steels of the present invention in order to provide stable secondary grain growth. While aluminum is helpful to control the oxygen levels during the steelmaking operation, the level of soluble aluminum must be maintained below the upper limit.

The steel may also include other elements such as, antimony, arsenic, bismuth, copper, molybdenum, nickel, phosphorus and the like made as deliberate additions or as impurities from steelmaking process which can affect the austenite volume fraction and/or the stability of secondary grain growth.

The initial anneal is normally conducted at 900°–1125° C. (1650°–2050° F.) and preferably at 980°–1080° C. (1800°–1975° F.) for a time of up to 10 minutes (preferably less than 1 minute) to provide the desired microstructure prior to the single cold reduction step. During the anneal, a sufficient volume fraction of austenite is needed. Carbon loss during annealing, which was common in prior practices, required an appropriate adjustment in the carbon melt composition to maintain the desired phase balance during annealing. Carbon loss during annealing has been reduced with the present invention wherein an addition of 0.11–1.2% chromium is provided. During the investigations of the present invention, it was observed that typical carbon loss during annealing at 1025° C. (1875° F.) in a highly oxidizing atmosphere was 0.007–0.008% for a steel containing less than 0.12% or less chromium whereas 0.005–0.006% or less carbon is lost when a 0.20–0.25% addition of chromium is provided. The amount of carbon loss also will vary with the band thickness, atmosphere, time and temperature of annealing.

After the annealed strip reaches the soak temperature of from 900°–1125° C. (1650°–2050° F.) for a time up to 10 minutes, the steel is cooled to room temperature. Typically, this would be an air cool. The preferred practice includes a water quench for a rapid cool to room temperature. The temperature at which the water quenching is started after the soak temperature has been reached is adjusted for the steels of the present invention depending on the amount of chromium used. The preferred practice would thus include a slow cool, such as by air, from the soak temperature to a temperature from 480°–870° C. (900°–1600° F.) and, more preferably, to 575°–700° C. (1070°–1290° F.) followed by rapid cooling, such as would be provided by water quenching, to a temperature below 100° C. (212° F.). The process of cooling after annealing is important since control of the austenite decomposition process is desired. During the initial stage of cooling, austenite decomposition into carbon-saturated ferrite to provide fine carbide precipitates and/or carbon in solution to enhance the (110)[001] texture is desired while the final stage of rapid cooling produces pearlite with a small amount, but desireable, amount of martensite.

The regular grain oriented electrical steel of the present invention can be produced from bands made by a number of methods. Bands produced by reheating continuous cast slabs to temperatures of 1260°–1400° C. (2250°–2550° F.) followed by hot rolling to 1.57–1.88 mm (0.062–0.074 inch) thickness have been processed to produce a 0.345 mm (0.0136 inch) thick product. Prior practices for the production of 0.345 mm thick regular grain oriented using a two stage cold rolling method employed bands of 2.0–3.0 mm (0.08–0.12 inch) in thickness. The present invention is also applicable to bands produced by methods wherein ingots or continuously cast slabs are fed directly to the hot mill without significant heating, or ingots are hot reduced into slabs of sufficient temperature to hot roll to band without further heating, or by casting the molten metal directly into a band suitable for further processing. In some instances, equipment capabilities may be inadequate to provide the appropriate band thicknesses needed for the practice of the present invention; however, a small cold reduction of 30% or less may be employed prior to the band anneal or the band may be hot reduced by up to 50% to a more appropriate thickness.

The optimum amount of cold reduction using the single cold reduction process of the present invention is dependent on the product final thickness. It has been determined that a wide range of final thicknesses can be produced provided that the proper cold reductions are employed. Regular grain oriented electrical steels of 0.345 mm (13.6 mils) and 0.284 mm (11.2 mils) final thicknesses have been manufactured in the plant using the single cold reduction process of the present invention. Laboratory studies have successfully produced regular oriented electrical steels having final thicknesses of from 0.45 mm (17.6 mils) to 0.264 mm (10.4 mils). Equation (1) can be used to determine the thickness of the annealed band (to) based on the relationships between the cold reduction and final product ($t_o$) determined in laboratory studies.

$$t_o = t_f \exp[(K/t_f)^{0.25}] \quad (3)$$

The thickness of the annealed band prior to cold rolling is $t_o$, $t_f$ is the final product thickness and K is a constant having a value of from 2.0 to 2.5. K is related to the intrinsic characteristics of the band, i.e., the qualities of the initial microstructure, texture and grain growth inhibitor(s). The value of K can be determined by one skilled in the art by routine experimentation wherein the magnetic properties, particularly the quality of the (110)[001] orientation, are determined by cold reducing bands to samples of various final thicknesses. The intrinsic qualities of the band used in the development of the present invention, as defined within the preferred embodiments for composition and processing, provided a value of K about 2.3. The optimum magnetic properties achieved at the standard product thicknesses of 0.45 mm (0.0176 inch), 0.345 mm (0.0136 inch), 0.295 mm (0.0116 inch) and 0.260 mm (0.0102 inch) in these studies determined that the optimum band thicknesses after annealing were 1.95–2.08 mm (0.078–0.082 inch), 1.65–1.78 mm (0.065–0.070 inch), 1.52–1.65 mm (0.060–0.065 inch) and 1.45–1.57 mm (0.057–0.062 inch) for each respective final product thickness. The production of still lighter thicknesses such as 0.23 mm (0.0082 inch), 0.18 mm (0.0071 inch) and 0.15 mm (0.0058 inch) regular grain oriented may be achieved using bands of the appropriate thickness. Based on the experimental results used to develop Equation (1), the band thicknesses for each respective final thickness are 1.25–1.40 mm (0.049–0.055 inch), 1.15–1.27 mm (0.045–0.050 inch) and 1.00–1.15 mm (0.040–0.045 inch). Such thicknesses may be outside the capabilities of some conventional hot strip mills; however, a cold reduction of 30% or less may be employed prior to the band anneal or the band may be hot reduced by up to 50% to provide a band of the appropriate thickness suitable for the single cold reduction process of the present invention.

After cold reduction to final thickness is completed, conventional decarburization is required to reduce the C level to avoid magnetic aging, typically less than 0.003% C. In addition, the decarburization anneal prepares the steel for the formation of a forsterite, or "mill glass", coating in the high temperature final anneal by reaction of the surface oxide skin and the annealing separator coating. It was determined that ultra-rapid annealing as part of the decarburizing process as taught in U.S. Pat. No. 4,898,626 may be used to increase productivity, but no magnetic quality gains were observed.

The final high temperature anneal is needed to develop the (110)[001] grain orientation or "Goss" texture. Typically, the steel is heated to a soak temperature of at least about 1100° C. (2010° F.) in a $H_2$ atmosphere. During heating, the (110)[001] nuclei begin the process of secondary grain growth at a temperature of about 850° C. (1575° F.) and which is substantially completed by about 980° C. (1800° F.). Typical annealing conditions used in the practice of the present invention employed heating rates of up to 50° C. (90° F.) per hour up to about 815° C. (1500° F.) and further heating at rates of about 50° C. (90° F.) per hour, and, preferably, 25° C. (45° F.) per hour or lower up to the completion of secondary grain growth at about 980° C. (1800° F.). Once secondary grain growth is complete, the heating rate is not as critical and may be increased until the desired soak temperature is attained wherein the material is held for a time of at least 5 hours (preferably at least 20 hours) for removal of the S and/or Se inhibitors and for removal of impurities as is well known in the art.

EXAMPLE 1

A series of heats were melted and processed in the plant to a final thickness of 0.345 mm (13.6 mils) in accordance with the practice of the present invention. The melt composition of the heats are shown in Table 1. The examples from Table 1 were used to provide the data points in FIG. 1.

the dried coating was 12 gm/m$^2$ which provided a total of 44 mg/m$^2$ of sulfur. The coated sheet was final annealed in coil form by heating in $H_2$ at a rate of about 30° C./hr (55° F./hr) up to 750° C. (1380° F.) and about 15° C./hr (35° F./hr) to 1175° C. (2150° F.) and holding at 1175° C. (2150° F.) for at least 15 hours. The permeabilities measured at 796 A/m (B8) and core losses measured at 1.7 T 60 Hz in Table I and FIG. 1 shows that excellent and consistent magnetic properties obtained on Heats A through O while Heats P, Q and R showed degraded magnetic properties when the sum of Sn and excess Mn exceeded 0.028% based on the calculation of

TABLE 1

| | Summary of Magnetic Quality at 0.35 mm (13.6 mils) | | | | | | | | | | | | | |
|---|---|---|---|---|---|---|---|---|---|---|---|---|---|---|
| | Heat Chemistry (weight percent) | | | | | | | | γ1150° C. | | Glass Film | | Secondary | |
| ID | % C | % Mn | % S | % Si | % Cr | % Sn | % XS Mn | % XS Mn +.46% Sn | Before Anneal | After Anneal | P1760 W/kg | B8 Perm | P1760 W/kg | B8 Perm |
| A | .036 | .056 | .021 | 3.16 | .090 | .008 | .0202 | .0224 | 18% | 12% | 1.79 | 1824 | | |
| B | .034 | .059 | .024 | 3.17 | .054 | .008 | .0181 | .0217 | 16% | 10% | 1.86 | 1818 | 1.87 | 1818 |
| C | .035 | .052 | .024 | 3.19 | .064 | .009 | .0106 | .0131 | 16% | 11% | 1.86 | 1825 | 1.88 | 1816 |
| D | .036 | .053 | .024 | 3.14 | .062 | .008 | .0128 | .0151 | 18% | 12% | 1.87 | 1823 | 1.88 | 1825 |
| E | .036 | .054 | .022 | 3.19 | .053 | .009 | .0173 | .0198 | 16% | 11% | 1.83 | 1827 | 1.86 | 1823 |
| F | .036 | .053 | .021 | 3.21 | .051 | .011 | .0168 | .0199 | 16% | 11% | 1.81 | 1832 | 1.89 | 1825 |
| G | .036 | .054 | .022 | 3.12 | .041 | .012 | .0158 | .0191 | 18% | 13% | 1.81 | 1836 | 1.89 | 1828 |
| H | .035 | .055 | .021 | 3.13 | .096 | .008 | .0187 | .0209 | 17% | 12% | 1.84 | 1828 | 1.83 | 1829 |
| I | .037 | .055 | .022 | 3.09 | .056 | .005 | .0170 | .0184 | 20% | 15% | 1.82 | 1832 | | |
| J | .035 | .056 | .022 | 3.14 | .070 | .009 | .0190 | .0215 | 17% | 12% | 1.81 | 1828 | | |
| K | .036 | .055 | .021 | 3.16 | .059 | .009 | .0190 | .0215 | 18% | 13% | 1.84 | 1824 | | |
| L | .036 | .055 | .022 | 3.13 | .047 | .012 | .0176 | .0209 | 18% | 13% | 1.87 | 1812 | | |
| M | .034 | .054 | .021 | 3.12 | .079 | .011 | .0178 | .0208 | 17% | 12% | 1.86 | 1818 | | |
| N | .036 | .055 | .022 | 3.12 | .050 | .009 | .0173 | .0198 | 18% | 13% | 1.83 | 1827 | | |
| O | .035 | .058 | .021 | 3.18 | .059 | .011 | .0213 | .0264 | 17% | 11% | 1.81 | 1834 | 1.83 | 1819 |
| P | .035 | .066 | .022 | 3.18 | .085 | .009 | .0278 | .0319 | 17% | 12% | | | 1.93 | 1751 |
| Q | .035 | .059 | .020 | 3.12 | .066 | .011 | .0244 | .0295 | 18% | 13% | | | 2.00 | 1767 |
| R | .035 | .074 | .020 | 3.22 | .164 | .006 | .0388 | .0416 | 16% | 10% | 2.02 | 1739 | 2.14 | 1735 |

The heats all had chemistries balanced to provide $\gamma_{1150°\ C.}$ of from about 10% to about 15% and include a balance of iron and normal residual elements such as boron of 0.0005% or less, molybdenum of 0.06% or less, nickel of 0.15% or less, phosphorus of less than 0.01% or less, and antimony of 0.0015% or less. The heats were continuously cast into 200 mm thick slabs, heated to about 1150° C., prerolled to 150 mm thick slabs, heated to about 1400° C. and rolled to 1.65–1.75 mm thick bands. The bands were annealed in an oxidizing atmosphere at 1025°–1065° C. for 15–30 seconds, air cooled to 550°–600° C. and water spray quenched to a temperature below 100° C. Based on melt composition and carbon lost during annealing, the volume fraction of austenite, ($\gamma_{1150°\ C.}$), was from 10–15% as per the preferred practice of the present invention. The annealed bands were reduced on a three-stand tandem cold mill to 0.345 mm thickness and decarburized at about 850°–870° C. (1575°–1600° F.) in a wet $H_2$-$N_2$ atmosphere. The decarburized sheets were coated with a MgO slurry containing $MgSO_4 \cdot 7(H_2O)$ to provide a dried annealing separator coating weighing 6 gm/m$^2$ on each sheet surface which further provided 22 mg/m$^2$ of sulfur on each sheet surface. Thus the total weight of Equation (1). These results show regular grain oriented steels produced by a single cold reduction process requires the level of Sn and excess Mn be controlled to a level of 0.03% or less to provide consistent magnetic quality.

EXAMPLE 2

Figure 2:
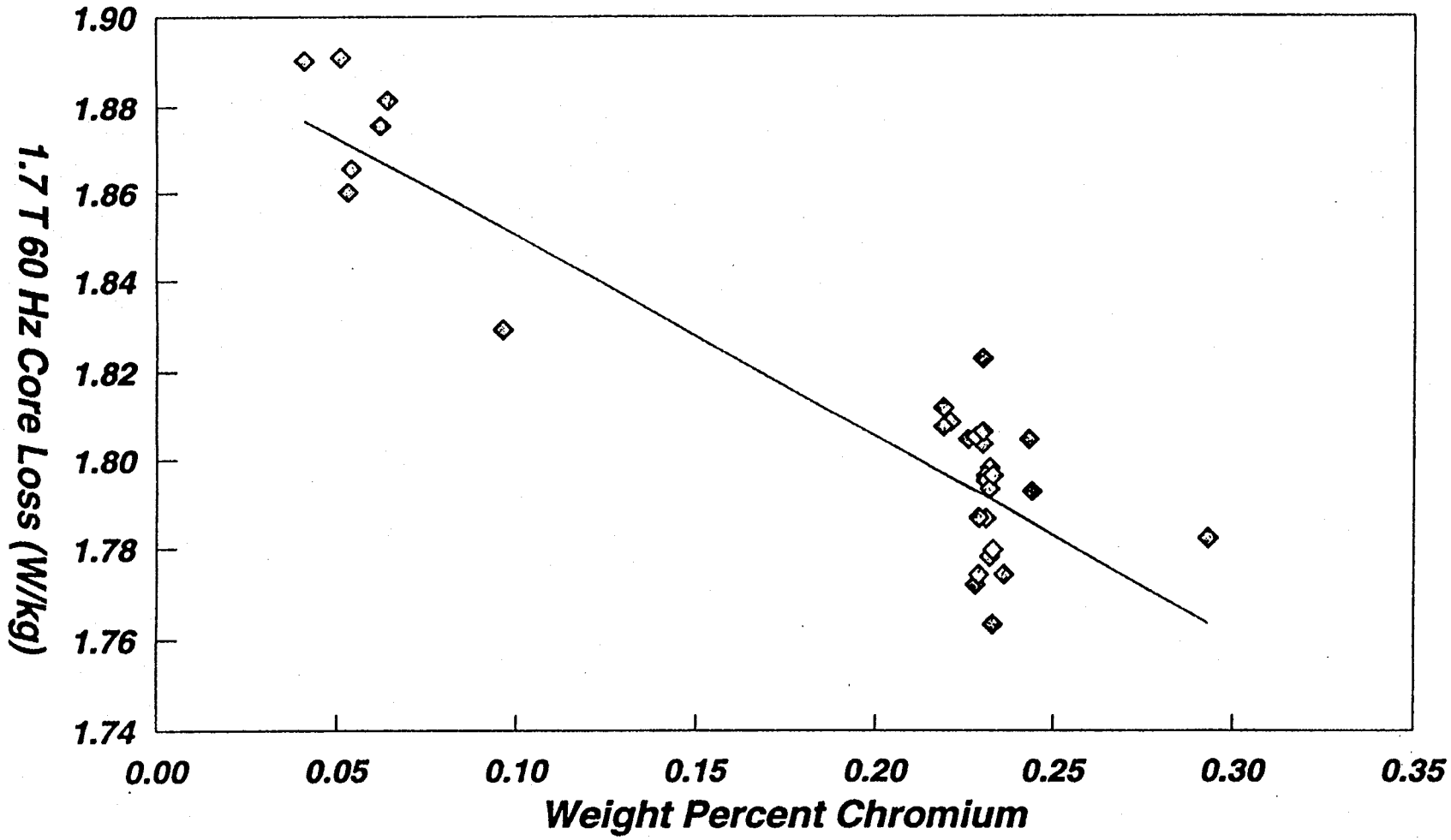
FIG. 2 is a graph exemplifying the relationship between the amount of chromium and the 1.7 T 60 Hz core loss of regular grain oriented electrical steel.

In addition to Hems A through R in Example 1, a further series of heats were melted and processed in the plant to a final thickness of 0.345 mm in accordance with the practice of the present invention. The melt compositions of the additional heats are shown in Table 2. The composition of these additional heats incorporated chromium contents of greater than 0.17%; all processing was otherwise identical to the heats of Example 1. The permeabilities measured at 796 A/m and core losses measured at 1.7 T 60 Hz in Table I show that excellent and consistent magnetic properties obtained on Heats S through AQ. FIG. 2 summarizes the 1.7 T 60 Hz core losses from the heats from both Examples 1 and 2 which show the beneficial effect of chromium additions of the present invention on magnetic quality. The data shown in Table 2 was used to prepare FIG. 2.

TABLE 2

| | Summary of Magnetic Quality at 0.35 mm (13.6 mils) | | | | | | | | | | | | | |
|---|---|---|---|---|---|---|---|---|---|---|---|---|---|---|
| | Heat Chemistry (weight percent) | | | | | | | | γ1150° C. | | Glass Film | | Second. Coating | |
| ID | % C | % Mn | % S | % Si | % Cr | % Sn | % XS Mn | % XS Mn +.46% Sn | Before Anneal | After Anneal | P1760 W/kg | B8 Perm | P1760 W/kg | B8 Perm |
| S | .034 | .056 | .021 | 3.12 | .243 | .008 | .020 | .022 | 18% | 14% | 1.76 | 1836 | 1.80 | 1834 |
| T | .035 | .056 | .021 | 3.14 | .203 | .010 | .020 | .023 | 18% | 14% | 1.77 | 1839 | | |
| U | .037 | .054 | .022 | 3.15 | .232 | .010 | .017 | .020 | 20% | 16% | 1.74 | 1841 | 1.78 | 1839 |
| V | .035 | .054 | .021 | 3.15 | .293 | .010 | .018 | .021 | 18% | 14% | 1.75 | 1838 | 1.78 | 1834 |
| W | .037 | .054 | .022 | 3.14 | .221 | .010 | .016 | .019 | 19% | 16% | 1.80 | 1829 | 1.81 | 1824 |
| X | .038 | .055 | .022 | 3.12 | .226 | .012 | .017 | .021 | 20% | 17% | 1.79 | 1829 | 1.80 | 1826 |

TABLE 2-continued

| Summary of Magnetic Quality at 0.35 mm (13.6 mils) | | | | | | | | | | | | | | |
|---|---|---|---|---|---|---|---|---|---|---|---|---|---|---|
| Heat Chemistry (weight percent) | | | | | | | | | γ1150° C. | | Glass Film | | Second. Coating | |
| ID | % C | % Mn | % S | % Si | % Cr | % Sn | % XS Mn | % XS Mn +.46% Sn | Before Anneal | After Anneal | P1760 W/kg | B8 Perm | P1760 W/kg | B8 Perm |
| Y | .038 | .055 | .024 | 3.15 | .230 | .011 | .014 | .017 | 20% | 16% | 1.80 | 1828 | 1.80 | 1831 |
| Z | .037 | .054 | .022 | 3.12 | .233 | .012 | .016 | .019 | 20% | 16% | 1.77 | 1838 | 1.78 | 1833 |
| AA | .038 | .055 | .023 | 3.18 | .230 | .012 | .017 | .020 | 19% | 15% | 1.83 | 1828 | 1.82 | 1823 |
| AB | .038 | .054 | .023 | 3.14 | .232 | .008 | .015 | .018 | 20% | 16% | 1.78 | 1834 | 1.80 | 1828 |
| AC | .038 | .054 | .021 | 3.13 | .228 | .008 | .017 | .020 | 20% | 17% | 1.77 | 1834 | 1.81 | 1826 |
| AD | .038 | .055 | .022 | 3.14 | .228 | .011 | .017 | .020 | 20% | 16% | 1.76 | 1837 | 1.77 | 1835 |
| AE | .036 | .054 | .022 | 3.12 | .233 | .012 | .016 | .019 | 20% | 16% | 1.75 | 1832 | 1.76 | 1833 |
| AF | .036 | .056 | .022 | 3.16 | .231 | .012 | .019 | .022 | 18% | 15% | 1.76 | 1834 | 1.80 | 1824 |
| AG | .037 | .055 | .022 | 3.33 | .229 | .011 | .017 | .020 | 15% | 11% | | | 1.77 | 1821 |
| AH | .037 | .055 | .022 | 3.15 | .231 | .010 | .018 | .021 | 20% | 16% | | | 1.79 | 1831 |
| AI | .037 | .055 | .021 | 3.15 | .229 | .009 | .019 | .021 | 19% | 15% | | | 1.79 | 1829 |
| AJ | .037 | .057 | .021 | 3.18 | .236 | .007 | .020 | .022 | 18% | 14% | | | 1.77 | 1836 |
| AK | .036 | .055 | .022 | 3.16 | .231 | .008 | .018 | .020 | 19% | 15% | | | 1.79 | 1824 |
| AL | .036 | .055 | .022 | 3.16 | .230 | .010 | .017 | .020 | 18% | 14% | | | 1.81 | 1823 |
| AM | .037 | .059 | .024 | 3.15 | .219 | .015 | .019 | .023 | 19% | 15% | 1.80 | 1826 | 1.81 | 1824 |
| AN | .038 | .054 | .022 | 3.31 | .219 | .008 | .016 | .018 | 16% | 12% | 1.79 | 1824 | 1.81 | 1818 |
| AO | .036 | .054 | .022 | 3.13 | .232 | .010 | .017 | .020 | 19% | 15% | 1.76 | 1832 | 1.79 | 1827 |
| AP | .038 | .056 | .021 | 3.17 | .244 | .007 | .019 | .021 | 20% | 16% | 1.71 | 1844 | 1.79 | 1828 |
| AQ | .037 | .055 | .022 | 3.16 | .233 | .005 | .018 | .019 | 19% | 15% | 1.75 | 1841 | 1.80 | 1835 |

EXAMPLE 3

Figure 3:
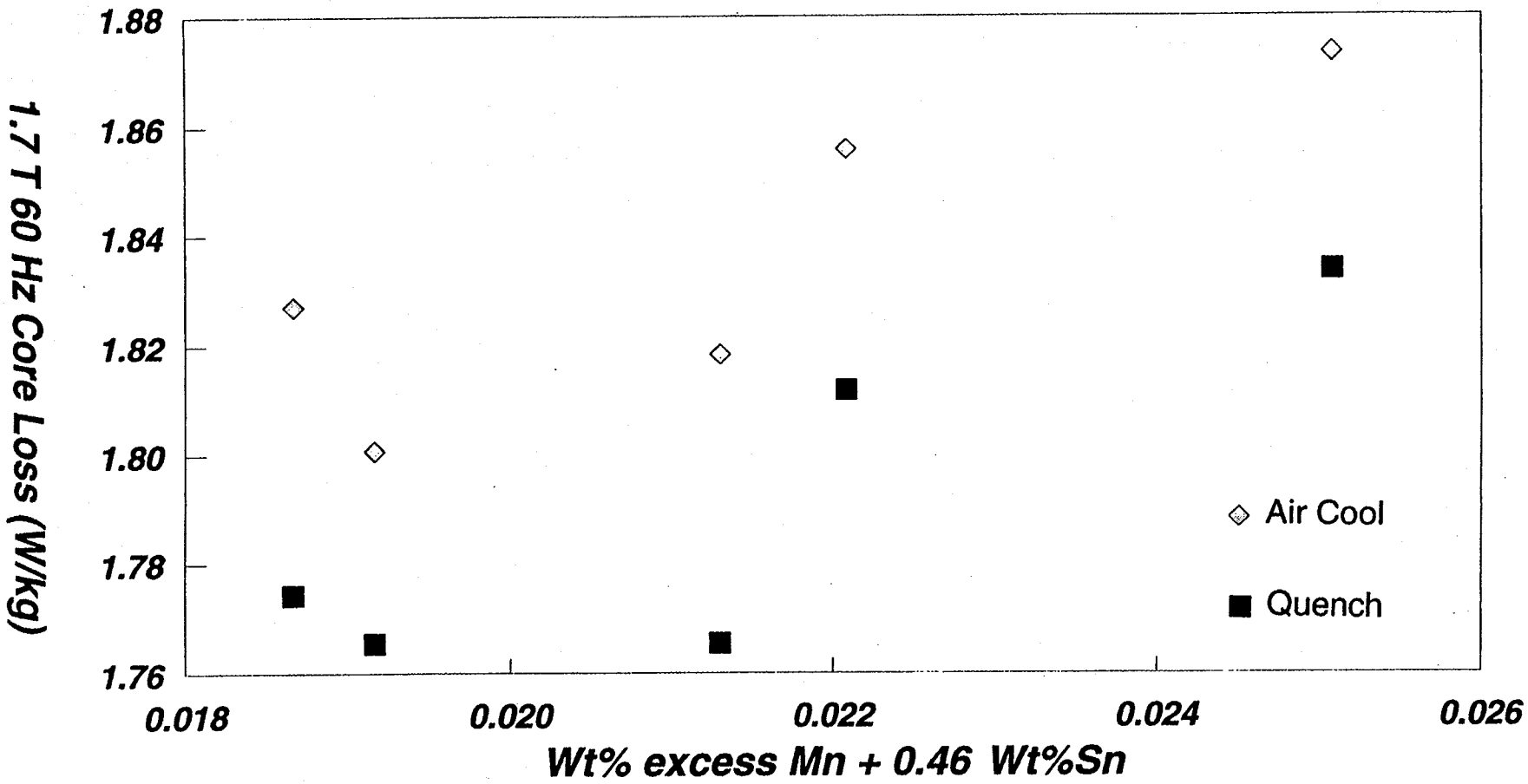
FIG. 3 is a graph exemplifying the relationship between the amount of tin and excess manganese and the 1.7 T 60 Hz core loss of regular grain oriented electrical steel depending on the cooling conditions following the initial anneal.

A series of heats were melted and processed to a final thickness of 0.345 mm in accordance with the practice of the present invention. The melt compositions of these heats are shown in Table 3. The results from this experiment were used to prepare FIG. 3.

TABLE 3

| Summary of Magnetic Quality at 0.35 mm (13.6 mils) | | | | | | | | | | | | | | |
|---|---|---|---|---|---|---|---|---|---|---|---|---|---|---|
| Heat Chemistry (weight percent) | | | | | | | | | γ1150° C. | | 580° C. Quench | | Air Cool | |
| ID | % C | % Mn | % S | % Si | % Cr | % Sn | % XS Mn | % XS Mn +.46% Sn | Before Anneal | After Anneal | P1760 W/kg | B8 Perm | P1760 W/kg | B8 Perm |
| AR | .036 | .054 | .022 | 3.15 | .233 | .012 | .016 | .021 | 18% | 14% | 1.77 | 1839 | 1.82 | 1826 |
| AS | .041 | .055 | .022 | 3.16 | .249 | .010 | .018 | .022 | 21% | 17% | 1.81 | 1834 | 1.86 | 1820 |
| AT | .038 | .057 | .022 | 3.20 | .246 | .013 | .019 | .025 | 18% | 14% | 1.83 | 1826 | 1.87 | 1816 |
| AU | .037 | .054 | .023 | 3.13 | .232 | .007 | .015 | .018 | 19% | 15% | 1.77 | 1843 | 1.83 | 1826 |
| AV | .037 | .054 | .022 | 3.14 | .233 | .007 | .016 | .019 | 19% | 15% | 1.77 | 1837 | 1.80 | 1829 |
| Average Magnetic Quality With 580° C. Quench | | | | | | | | | | | 1.79 | 1836 | 1.84 | 1823 |
| After Initial Anneal vs Average Air Cool Improvement With Present Invention | | | | | | | | | | | 0.05 | 13 | | |

As Table 3 shows, the steel compositions of these heats incorporated Sn and excess Mn levels of 0.025% or less and chromium levels of 0.23–0.25% in accordance with the preferred practice of the present invention. Plant processing was identical to Examples 1 and 2 except that the bands were annealed at 1025°–1065° C. for 15–30 seconds and cooled from soak temperature by either air cooling to ambient temperature or by cooling to 550°–600° C. followed by rapid cooling using water spray quenching to a temperature below 100° C. in accordance with the preferred practice of the present invention. The resulting magnetic quality results in Table 3 show that the use of rapid cooling using water quenching improved magnetic quality by providing higher B8 permeability and lower 1.7 T core loss.

EXAMPLE 4

A series of heats were melted and processed in the plant to a final thickness of 0.284 mm (11.2 mils) in accordance with the practice of the present invention. The melt compositions of these heats are shown in Table 4. All of the processing followed the preferred practices of the present invention and was identical to the processing for the heats of Examples 1, 2 and 3 except that the thickness of the hot rolled band was 1.65 mm (0.065"). After initial annealing, the band was rolled to 0.284 mm (11.2 mils) final thickness, decarburized and provided with a MgO separator coating containing a sulfur-bearing addition and final annealed per the practice of Example 1. As Table 4 shows, excellent and reproducible magnetic quality was obtained at 11.2 mils final thickness following the practice of the present invention. This work clearly demonstrates that the present invention produces excellent magnetic quality for thinner gauges produced using a single cold rolling process.

TABLE 4

| Summary of Magnetic Quality at 0.284 mm (11.2 mils) | | | | | | | | | | | | | |
|---|---|---|---|---|---|---|---|---|---|---|---|---|---|
| Heat Chemistry (weight percent) | | | | | | | | | γ1150° C. | | Magnetic Quality | | |
| ID | % C | % Mn | % S | % Si | % Cr | % Sn | % XS Mn | % XS Mn +.46% Sn | Before Anneal | After Anneal | P1760 W/kg | P1760 W/kg | B8 Perm |
| AW | .036 | .055 | .022 | 3.16 | .23 | .008 | .018 | .022 | 18% | 14% | 1.11 | 1.62 | 1822 |
| AX | .038 | .056 | .021 | 3.17 | .24 | .008 | .019 | .023 | 19% | 15% | 1.09 | 1.57 | 1836 |
| AY | .037 | .055 | .022 | 3.25 | .23 | .009 | .017 | .021 | 16% | 12% | 1.08 | 1.56 | 1834 |

The preferred embodiment discussed herein above has demonstrated that a single stage cold reduction process in combination with the other processing steps of the present invention does provide a consistent and excellent level of magnetic quality which compares favorably with the conventional two stage cold reduction processes of the prior art. The present invention may also employ a starting band which has been produced using methods such as thin slab casting, strip casting or other methods of compact strip production.

The invention as described herein above in the context of a preferred embodiment is not to be taken as limited to all of the provided details thereof, since modifications and variations thereof may be made without departing from the spirit and scope of the invention. It should also be understood that any preferred or more preferred range for one element may be used with the broad ranges for the other elements for the compositions of the invention.

What is claimed is:

1. A single stage cold reduction method for producing regular grain oriented electrical steel having improved magnetic properties, said method comprising the steps of:

a) providing a band which consists essentially of, in weight percent, 2.5–4.5% Si, 0.025–0.08% C, less than 0.005% Al, up to 0.04% S, up to 0.14% Se, 0.06% maximum Sn, 0.01–0.10% Mn, up to a total of Sn and excess Mn of 0.03%, 0.11–1.2% Cr, less than 0.01% N and balance essentially iron and normally occurring residual elements;

b) providing said band having a thickness of:

$$t_o = t_f \exp[(K/t_f)^{0.25}]$$

where to is the thickness of the band prior to cold rolling to final thickness, $t_f$ is the final product thickness and K being a constant having a value of from 2.0 to 2.5;

c) annealing said band at a soak temperature of from 900°–1125° C. (1650°–2050° F.) for a time up to 10 minutes;

d) providing $\gamma_{1150° C.}$ in said annealed band of at least 7% and maintaining at least 0.025% carbon throughout said annealing;

e) cold rolling said annealed band in a single stage to final strip thickness;

f) decarburizing said strip to a level sufficient to prevent magnetic aging;

g) adding at least 15 mg per square meter S onto at least one surface of said strip;

h) providing said strip with an annealing separator coating: and i) final annealing said coated strip at a temperature of at least 1100° C. (2010° F.) for at least 5 hours to effect secondary grain growth and thereby develop said improved magnetic properties.

2. The method claimed in claim 1 wherein said Cr addition is from 0.17–1.2%.

3. The method claimed in claim 1 wherein said Cr addition is from 0.2–0.5%.

4. The method claimed in claim 1 wherein said total Sn and excess Mn is maintained at a level below about 0.028%.

5. The method claimed in claim 1 wherein said austenite volume fraction in said annealed band is greater than 10%.

6. The method claimed in claim 1 wherein said Mn is from 0.05–0.06% and said S is from 0.02–0.03%.

7. The method claimed in claim 1 wherein said C is from 0.03–0.04% and said Si is from 2.9–3.5%.

8. The method claimed in claim 1 wherein said total S provided on said surface of said strip is at least 20 mg per square meter.

9. The method claimed in claim 1 wherein said initial annealing process includes slow cooling said band after said soak temperature to a temperature from 480°–870° C. (900°–1600° F.) followed by water quenching to a temperature below 100° C. (21 2° F.).

10. A method for producing regular grain oriented electrical steel having a permeability measured at 796 A/m of at least 1780 comprising the steps of:

a) providing a band having a thickness of from 1.0–2.1 mm, said band consisting essentially of, in weight percent 2.7–3.7% Si, 0.03–0.04% C, less than 0.005% Al, 0.025–0.04% S, up to 0.144 Se, 0.030–0.07% Mn with a maximum total of Sn and excess Mn of 0.028% and balance being essentially iron and normally occurring residual elements;

b) annealing said band at a temperature of from 900°–1125° C. (1650°–2050° F.) for a time up to 10 minutes and cooling said band to room temperature, said annealed band having $\gamma_{1150° C.}$ of at least 10%;

c) cold rolling said annealed band in a single stage by a reduction of greater than 75–90% to final gauge strip;

d) decarburizing said strip to a level sufficient to prevent magnetic aging;

e) adding at least 15 mg per square meter S onto at least one surface of said strip;

f) providing said strip with an annealing separator coating; and g) final annealing said coated strip for a time and temperature sufficient to develop secondary recrystallization and provide a permeability at 10 oersteds of at least 1780.

11. A single stage cold reduction method for producing regular grain oriented electrical steel having improved magnetic properties, said method comprising the steps of:

a) providing a band which consists essentially of, in weight percent, 2.5–4.5% Si, 0.025–0.08% C, less than 0.005% Al, up to 0.04% S, up to 0.14% Se, 0.06% maximum Sn, 0.01–0.10% Mn, up to a total of Sn and excess Mn of 0.03%, 0.17–1.2% Cr, less than 0.01% N and balance being essentially iron and normally occurring residual elements;

b) providing said band having a thickness of:

$$t_o = t_f \exp[(K/t_f)^{0.25}]$$

where to is the thickness of the band prior to cold rolling to final thickness, $t_f$ is the final product thickness and K being a constant having a value of from 2.0 to 2.5;

c) annealing said band at a soak temperature of from 900°–1125° C. (1650°–2050° F.) for a time up to 10 minutes;

d) providing $\gamma_{1150° C.}$ in said annealed band of at least 7% and maintaining at least 0.025% carbon throughout said annealing;

e) cold rolling said annealed band in a single stage to final strip thickness;

f) decarburizing said strip to a level sufficient to prevent magnetic aging;

g) adding at least 15 mg per square meter S onto at least one surface of said strip;

h) providing said strip with an annealing separator coating;

i) final annealing said coated strip at a temperature of at least 1100° C. (2010° F.) for at least 5 hours to effect secondary grain growth and thereby develop said improved magnetic properties.

* * * * *